United States Patent [19]

Cade

[11] 4,137,035

[45] Jan. 30, 1979

[54] BURNER CONTROL APPARATUS

[75] Inventor: Phillip J. Cade, Winchester, Mass.

[73] Assignee: Electronics Corporation of America, Cambridge, Mass.

[21] Appl. No.: 769,307

[22] Filed: Feb. 16, 1977

[51] Int. Cl.[2] ..... F23N 5/00

[52] U.S. Cl. ..... 431/78; 431/29; 431/51

[58] Field of Search ..... 431/29, 30, 31, 51, 431/78

[56] References Cited

U.S. PATENT DOCUMENTS

| | | | |
|---|---|---|---|
| 3,343,585 | 9/1967 | Eckelberry | 431/31 |
| 3,393,037 | 7/1968 | Giuffrida et al. | 431/31 X |
| 3,449,055 | 6/1969 | Blackett | 431/31 X |
| 4,035,135 | 7/1977 | Jacobst | 431/29 |

*Primary Examiner*—Edward G. Favors
*Attorney, Agent, or Firm*—Charles E. Pfund

[57] ABSTRACT

Burner control apparatus includes control devices for actuating an ignition control means, and a timing circuit for providing an ignition timing sequence of four precise intervals. The timing circuit is actuated in response to a request for burner operation and the control devices are energized in sequence and combination in response to the actuated timing circuit. Time sequential pilot flame and main flame stabilization intervals are provided. If a signal from the flame sensor is received before the end of the overlapping flame stabilization timing intervals, the control device is energized and if flame detection signal is lost a lockout circuit is energized.

19 Claims, 3 Drawing Figures

BURNER CONTROL APPARATUS

BACKGROUND OF THE INVENTION

This invention relates to electrical control circuits and more particularly to electrical control circuits particularly adapted for use in burner control systems.

Burner control systems are designed both to monitor the existence of flame in the supervised combustion chamber and to time sequences of operation of burner controls. Safety of burner operation is a prime consideration in the design of burner control systems. For example, if fuel is introduced into the combustion chamber and ignition does not take place within a reasonable time, an explosive concentration of fuel may accumulate in the combustion chamber. The burner control system should reliably monitor the existence of flame in the combustion chamber, accurately time a trial-for-ignition interval, inhibit ignition if a false flame signal is present, and shut down the burner in safe condition whenever a potentially dangerous condition exists. Examples of such burner control systems are disclosed in my U.S. Pat. No. 3,840,322.

Among the considerations in burner control system design are reliability of operation, manufacturing cost, the provision of precise timing cycles (particularly those of short duration), and the nature of the response of the burner control to a flame failure condition after flame has been established, for example, and immediate shut down of the burner system, an immediate attempt to re-establish flame, or an attempt to re-establish flame only after a pre-ignition (purge) interval.

SUMMARY OF THE INVENTION

In accordance with one aspect of the invention, there is provided a burner control apparatus for use with a fuel burner installation that has an operating control to produce a request for burner operation, a flame sensor to produce a signal when flame is present in the monitored combustion chamber, and one or more devices for control of ignition and/or fuel flow. The burner control apparatus comprises lockout apparatus for deenergizing the control apparatus, a control device for actuating the ignition and/or fuel control devices, and a timing circuit that provides four successive timing intervals of precise relation. As disclosed in the preferred embodiment two capacitors are employed for the timing intervals which are a function of the charging and discharging of the respective capacitors. An ignition sequence is commenced in response to a request for burner operation by actuating the timing circuitry and that timing circuitry energizes the control device at the end of the first or purge timing interval followed by a pilot ignition interval. The pilot ignition timing interval is followed by a pilot stabilization interval during which the flame should be established in the supervised combustion chamber. Following pilot flame stabilization the main fuel ignition interval establishes the main flame in the combustion chamber. If flame is established during this interval, the flame signal responsive circuitry maintains the control device energized. If flame is not established during this timing interval, the lockout apparatus operates to de-energize the control apparatus. A circuit coupled to the timing circuit prevents a further timing interval until either flame has been established, or the system senses and responds to the loss of a flame signal from the flame sensor after flame has been established thereafter to cause the timing circuit to provide at least a further ignition timing interval.

A modified version of the circuit operates to prevent a further ignition timing interval and causes the lockout apparatus to operate when this mode of operation is desired.

Other objects, features and advantages of the invention will be seen as the following description of particular embodiments progresses, in connection with the drawings.

DESCRIPTION OF THE PREFERRED EMBODIMENTS

Figure 1:
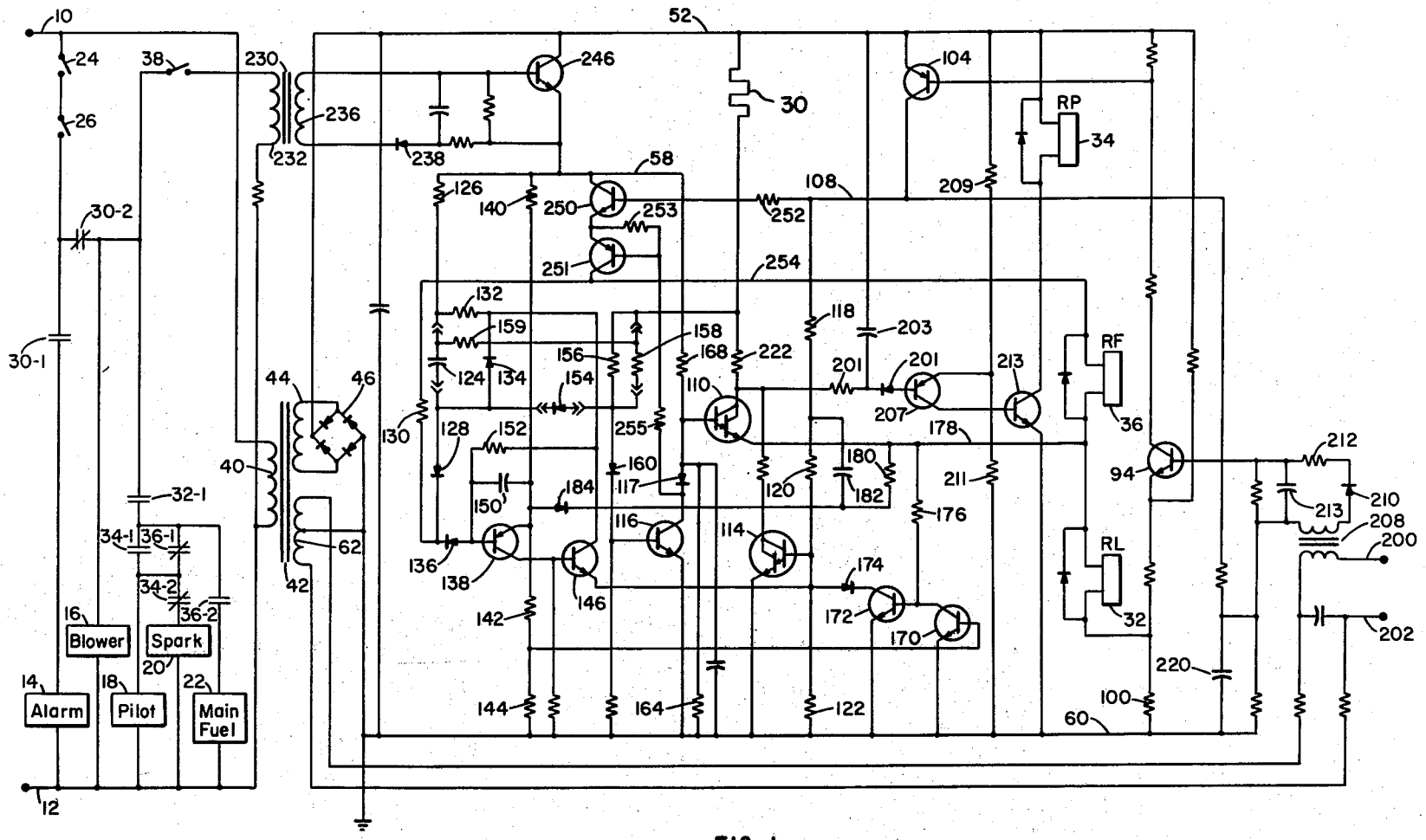
FIG. 1 is a schematic diagram of a burner control system constructed in accordance with the invention.

With reference to FIG. 1, the illustrated burner control arrangement includes terminals 10, 12 adapted to be connected to a suitable source of power, a typical source being, for example, a 240-volt, 50Hz source. Connected to those terminals is a control section that includes alarm device 14, blower 16, pilot fuel control 18, spark ignition control 20, and main fuel control 22. Limit switch 24 and operating control 26 such as a thermostat are connected in series to terminal 10. Normally open lockout contacts 30-1 are connected in series with alarm device 14 and normally closed lockout contacts 30-2 are connected in series between operating control 26 and the other deivces of the control section. Normally open control relay contacts 32-1 control the application of power to the ignition and fuel controls 18, 20 and 22 via further contacts; normally open pilot relay contacts 34-1 are connected in series with pilot fuel control 18; in series with normally closed flame relay contacts 36-1 which are connected in series with the pilot fuel control 18 and through normally closed pilot relay contacts 34-2 to ignition control 20; and normally open flame relay contacts 36-2 are connected in series with main fuel control 22.

A first secondary winding 44 of a transformer 42 has a full wave rectifier 46 connected across its terminals to provide DC power for the electronics section, that power being applied to main bus 52. The primary winding 40 of transformer 42 is connected directly to terminals 10, 12 so that bus 52 is continuously energized. The secondary winding 62 of that transformer supplies power to terminals 200, 202 to which a flame sensor of the UV type is connected. The flame signal pulses are coupled by transformer 208 and a rectifier circuit that includes diode 210 to the base electrode of a transistor 94. Transistor 94 in turn controls a transistor 104 which when conducting applies power to flame signal bus 108.

Auxiliary transformer 230 has its primary winding 232 connected in series with an air flow switch 38 and its secondary winding 236 connected through a rectifier circuit that includes diode 238 to the base of transistor switch 246. When air flow switch 38 is closed by air from blower 16, power is applied through transformer 230 to close switch 246 and apply B+ power from bus 52 to bus 58.

A lockout timing circuit connected to bus 52 includes a thermally responsive lockout actuator 30 which is energized through two actuating circuits comprising a first actuating circuit through a resistor 222, Darlington pair 110 control relay coil 32 and resistor 100 to ground bus 60 and a second actuating circuit through resistors 222 and 112 and Darlington pair 114 to ground bus 60. The control electrode of Darlington pair 110 is connected to transistor 116 via diode 117 while the control electrode of Darlington pair 114 is connected to a voltage divider network of resistors 118, 120 and 122 connected between flame signal bus 108 and ground bus 60.

Connected to auxiliary bus 58 is a timing circuit that includes tantalum timing capacitor 124 whose positive terminal is connected to bus 58 through resistor 126 and whose negative terminal is connected to bus 254 through diode 128 and resistor 130. Connected across timing capacitor 124 are resistor 132 and diode 134. Connected to the junction between diode 128 and resistor 130 via diode 136 is the base of transistor 138. The collector of transistor 146 is connected to the junction of resistor 132 and diode 134.

Connected between the negative terminal of timing capacitor 124 and lockout actuator 30 is a network of diode 154 and resistors 156 and 158. Diode 160 connects the junction of diode 154 and resistors 156, 158 to the base of transistor 116 which is returned to ground via resistor 162. Darlington pair 110 is triggered into conduction by the turn off of transistor 116. Resistor 159 protects capacitor 124 from the application of reverse voltage.

The circuit for control of Darlington pair 114 includes transistors 170, 172, the collector of transistor 172 being connected via diode 174 to the base control electrode of Darlington pair 114. Darlington pair 114 is triggered into conduction in response to a flame signal on bus 108 applied through voltage divider network of resistors 118, 120 and 122 or conduction of transistor 146 unless its control electrode is clamped to ground via diode 174 by transistor 172 in conduction. The base of transistor 172 is connected by resistor 176 to line 178. An unlatching network, responsive to loss of signal on bus 108, includes resistor 180, coupling capacitor 182 and diode 184 connected to the emitter of transistor 138.

Timing capacitor 124, diode 154, resistor 158 and resistor 159 are mounted on a plug-in timing card and enable the pre-ignition interval T1 and trial-for-ignition interval T2+T3 to be readily changed as desired by substitution of different cards.

Auxiliary bus 58 is connected to energize auxiliary bus 254 via two series transistors 250 and 251. The base of transistor 250 is connected via resistor 252 to the flame presence signal line 108. The joint emitters of transistors 250, 251 are connected through a resistor 253 to the base of transistor 251 which is connected through a resistor 255 to the collector of transistor 116. The collector of transistor 116 is connected through a diode 117 to the base of Darlington 110 biased by the voltage divider resistors 168, 164.

The collector output of Darlington 110 drives an RC timing network comprising resistor 201 and capacitor 203, the junction of which is coupled via diode 205 to the base of a transistor 207. The emitter of transistor 207 is biased at a fixed level by a voltage divider consisting of resistors 209, 211 and the collector of transistor 207 drives the base of a transistor 213. The transistor 213 when conducting energizes relay coil 34 which is connected in series from B+52 to ground 60 via the collector emitter path of transistor 213. The energized state of relay coil 34 is thus controlled by conduction in transistor 213 which in turn is determined by the voltage charge level of capacitor 203.

In operation, limit switch 24 is normally closed, and in response to a call for burner operation, switch 26 closes and power is applied to the control section. Blower 16 is energized through normally closed lockout contacts 30-2. When air flow switch 38 closes, power is applied via transformer 230 and rectifier 238 to bus 58 in the electronics section.

The elctronics section times two successive intervals based on charge and discharge of capacitor 124, a first blower (pre-ignition) interval T1 in which capacitor 124 is charged and a second pilot ignition and stabilization (ignition) interval T2+T3 in which the capacitor 124 is discharged. The timing of intervals T2 and T3 will be described later. As capacitor 124 charges, the voltage at the junction between diodes 128 and 136 drops towards the voltage on ground bus 60, controlling the first (pre-ignition) time delay interval T1 as a function of the RC values in that capacitor charging circuit (through resistor 130, relay coils 36 and 32, and resistor 100). When the voltage at that junction has dropped sufficiently the interval T1 is ended by transistor 138 turning on, the resulting current flow turning on transistor 146 and a signal is fed back through resistor 152 to maintain (latch) transistor 138 in conducting condition. Conduction of transistor 146 abruptly drops the voltage on the plus side of capacitor 124. This voltage transition is coupled through capacitor 124 and by diodes 154 and 160 applied to turn off transistor 116 and to turn on Darlington pair 110. As a result, current flows through a low resistance path of lockout actuator 30, resistor 222, Darlington pair 110, line 178, control relay coil 32 and resistor 100 to ground 60. Relay 32 is thus pulled in, closing contacts 32-1 and energizing pilot fuel control 18 and ignition control 20, establishing an ignition condition in the supervised combustion chamber. This corresponds to the start of pilot ignition interval T2. Transistor 170 is turned off by conduction of transistors 138 and 146 and the signal on line 178 is coupled by resistor 176 to turn transistor 172 on, clamping the control electrode of Darlington pair 114 to ground and thus holding lockout actuator alternate energizing path through Darlington 114 non-conductive. The voltage rise at the junction of resistor 100 and relay coil 32 compensates for the voltage drop on supply bus 52 which occurs when the low resistance path through Darlington pair 110 is conductive so that there is no marked change in the reference voltage at the emitter of transistor 94 and thus stabilizes the response of the flame sensing circuit to signals at terminal 200.

Figure 3:
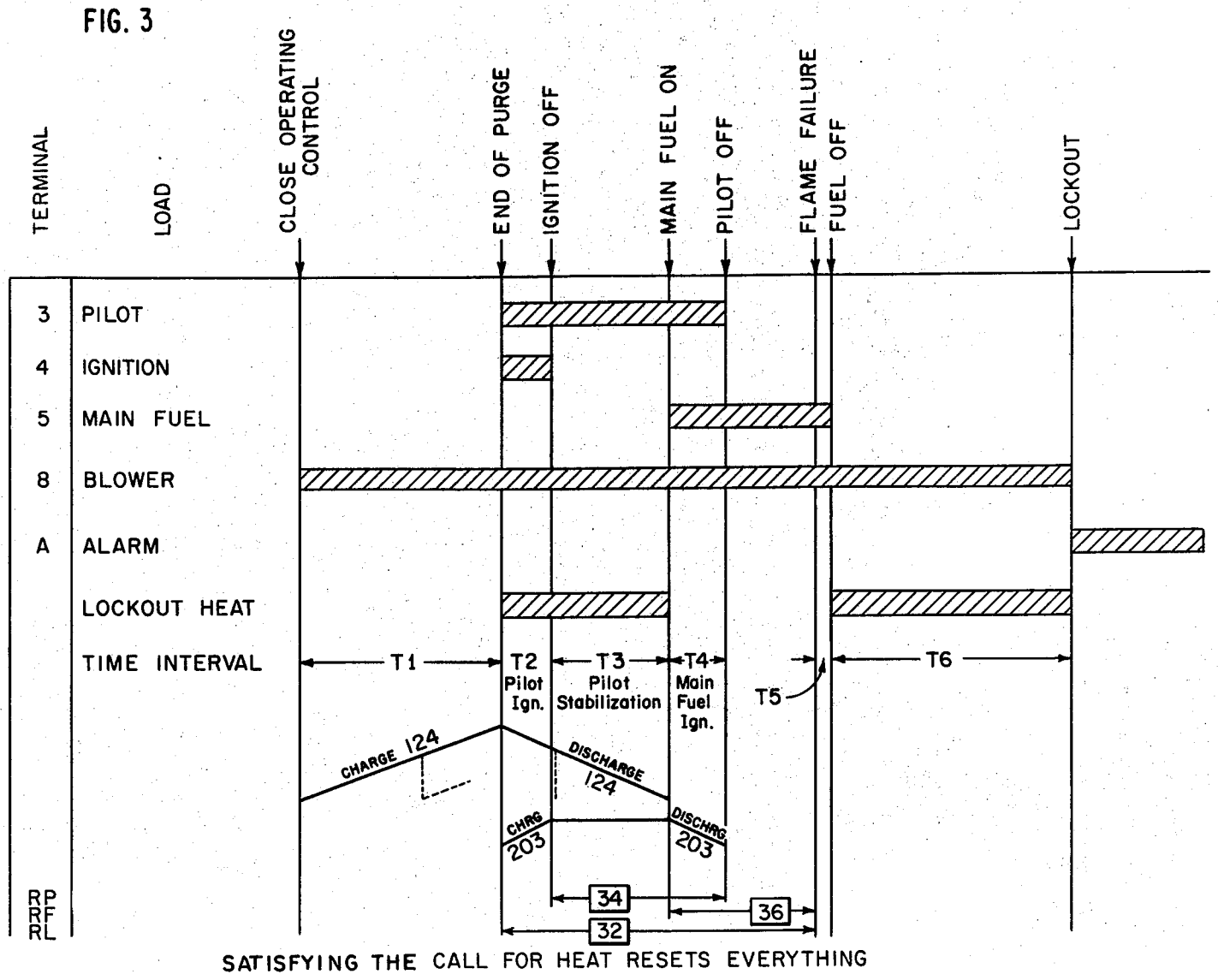
FIG. 3 is a timing diagram useful in describing operation of the invention.

The timing intervals for the circuit of FIG. 1 will now be explained referring to FIG. 3 for aid in description. Upon call for heat closing switch 26 to energize blower 16, the air flow switch 38 is closed in response to purge air thereby making transistor 246 conduct to charge capacitor 124. The charging time for capacitor 124 establishes the purge or pre-ignition interval T1 as previously described. Pre-ignition interval T1 ends at the start of pilot ignition timing interval T2 where capacitor 124 discharges at a rate determined essentially by the value of capacitor 124 and resistor 158 and establishes the interval T2+T3. As capacitor 124 discharges the potential on the base of transistor 116 rises and when transistor 116 is turned on, Darlington pair 110 is turned off, terminating the (ignition) interval T2+T3.

As previously noted, the discharge interval for capacitor 124, (T2+T3), is subdivided into a pilot ignition interval T2 and a pilot stabilization interval T3. These intervals are determined by the time constant for charging and discharging capacitor 203. When capacitor 203 charges to the point where transistors 207, 213 conduct, relay coil 34 is energized thereby interrupting ignition by opening contacts 34-2 and de-energizing the spark device 20. After the ignition has been turned off at the end of T2 the remainder of the interval T2+T3 provides the pilot stabilization period T3 which is terminated by the discharge of capacitor 124 as hereinbefore described. With this arrangement a stable pilot flame is established before the main fuel valve is turned on to initiate the main flame in the fire box. Similarly, at the end of pilot stabilization interval T3, a main fuel ignition interval T4 is established with the time interval determined by the discharge time for capacitor 203 which starts to discharge at the end of T3 thus corresponding to the start of interval T4. At the end of interval T4 when capacitor 203 has discharged, with main flame occurrence and maintenance having been established, the pilot flame is turned off by relay 34 dropping out corresponding to the end of main fuel ignition interval T4. Thus the operation and function of the system is modified and augmented by the intervals established by the charge and discharge circuits for capacitor 203 to supplement the intervals established by the charge and discharge of capacitor 124.

The timing of the intervals T2 and T4 under the control of the charge and discharge of capacitor 203 will now be described. After the purge period T1 the charge level of capacitor 124 is such that it turns off transistor 116 turning off transistor 251 which turns on Darlington pair 110 thereby energizing relay 32 which energizes pilot fuel supply 18 by closing contacts 32-1. When Darlington pair 110 is on the output electrode potential is applied across the RC circuit consisting of resistor 201 and capacitor 203 to start charging capacitor 203 thereby timing the pilot ignition interval T2. When the capacitor 203 has charged to a bias level determined by resistors 209, 211 biasing transistor 207 the transistor 207 is turned on turning on transistor 213 to energize relay coil 34. This charge level for capacitor 203 establishes the end of interval T2 and the energization of coil 34 closes contacts 34-1 and opens contacts 34-2 to respectively de-energize the ignition device 20 and establishing another path for maintaining pilot fuel device 18 on. As capacitor 124 continues to discharge it times out the end of interval T3 which turns on transistor 116 which turns on transistor 251 and if a flame has been detected as represented by flame signal on line 108 transistor 250 conducts thereby energizing relay coil 36 through transistors 250, 251. Current through relay coil 36 actuates its contacts to close contacts 36-2 to supply the main fuel to the burner and open contacts 36-1 to interrupt the initial circuit for energizing pilot fuel supply 18 which, however, remains energized by the closed contacts 34-1. When transistor 116 is turned on at the start of T4, Darlington pair 110 turns off and the RC circuit of resistor 201 and capacitor 203 starts to discharge. The discharge period for capacitor 203 to reach its initial level where the bias on transistor 207 will switch transistor 207 off corresponds to the time interval T4 during which the main flame ignition is established. At the end of interval T4 transistors 207 and 213 are turned off thereby de-energizing relay coil 34 and terminating the pilot flame by de-energizing pilot control 18. Relays 36 and 32 remain energized due to the alternate energizing current path through transistors 250, 251. As long as the main fuel flame is detected by signals at terminals 200, 202 which result in a flame presence signal on line 108 the system continues operation with the main fuel supply controlled by energizing main fuel control 22 through the closed contacts 36-2, 32-1 and the normally closed alarm relay contacts 30-2.

Upon failure of the main flame and detection thereof by absence of main flame signal at terminals 200, 202 the signal resulting therefrom on line 108 immediately switches off transistor 250 thereby interrupting current flow to relay coils 32 and 36 which opens contacts 32-1 and 36-2 and cuts off all power including termination of main fuel flow by de-energizing main fuel control 22. The time for main fuel cut-off is indicated as interval T5 and generally is not more than one second maximum. A time constant circuit established by resistor 212 and capacitor 213 controls T5 to prevent initiation of main fuel cutoff for momentary flame flicker by eliminating the corresponding fluctuations in the flame presence signal applied to transistor 94. During normal main flame operation the system monitors the established flame until the operation request switch 26 opens, terminating the burner cycle.

If no flame signal voltage has been applied to bus 108, when Darlington pair 110 is turned off, control relay actuator 32 is de-energized opening contacts 32-1 and terminating ignition and fuel flow. The base voltage to transistor 172 is also removed so that that transistor ceases conduction (removing the clamp on Darlington pair 114) and an alternate lockout path is established as Darlington pair 114 is triggered into conduction through conducting transistor 142. Lockout actuator 30 thus continues to heat and at the end of its time delay, it opens normally closed contacts 30-2, shutting down the burner system, and closes normally open contacts 30-1, energizing alarm 14.

If, after establishment of normal burner operation, the flame signal disappears, indicating loss of flame, transistor 104 ceases to conduct, removing power from bus 108 and relay actuators 32 and 36 drop out. With the dropout of those relays, contacts 32-1 and 36-2 open, turning off fuel flow. However, the unlatching circuit of capacitor 182 and diode 184 couples a transition pulse to the emitter of transistor 138 to unlatch transistor 138 and 146 so that they cease conducting. Then the cycle of successive timing intervals is repeated. Capacitor 124 starts charging and times a pre-ignition (purge) interval. At the end of that interval, transistors 138 and 146 are turned on and an ignition interval is timed by the discharge of capacitor 124 as described above. If flame is not re-established within that interval, the burner system goes to lockout.

Should a spurious flame signal appear during the pre-ignition timing interval (prior to the switching of Darlington pair 110 into conduction), the voltage on flame signal bus 108 is coupled through feedback resistor 130 and prevents further charging of capacitor 124. That voltage is also applied through the divider network of resistors 118, 120 and 122 to turn on Darlington pair 114, completing a heating path for lockout actuator 30. (While pilot actuator 34 is energized, pilot control 18 is not energized as control contacts 32-1 remain open, the current through the series circuit of relay coils 36 and 32 being insufficient to pull in relay 32.) If that flame signal remains on bus 108, the burner system is locked out at the end of the timing interval of lockout actuator 30 and alarm 14 is energized. Should the spurious flame signal disappear before lockout, the timing of the pre-ignition interval is reinitiated. Should there be a momentary interruption of power at terminals 10, 12, the voltage on bus 58 drops more rapidly than the voltage on bus 52 as capacitor 56 has a smaller value than capacitor 50. Thus, if such an interruption occurs after flame is established, transistors 138 and 146 promptly cease conducting and the system recycles through the pre-ignition and ignition intervals as above-described when power is reapplied to terminals 10, 12.

Should the plug in card on which capacitor 124, diode 154 and resistor 158 are mounted be omitted, the circuit will lock out in response to a request for burner operation. Ground potential is applied to the base of transistor 138 through resistor 130, coils 36 and 32 and resistor 100, and thus that transistor turns on, turning on transistor 146. Darlington pair 114 is triggered into conduction by conduction of transistor 146 while Darlington pair 110 is held non-conducting as diode 54 is not in circuit. Lockout actuator 30, at the end of its time delay, opens contacts 30-2, shutting down the burner system, and closes contacts 30-1 energizing alarm 14.

Should the flame sensor connected at terminals 200, 202 spuriously indicate the presence of flame in the combustion chamber, its flame signal causes conduction of transistor 104 which applies a signal through the divider network of resistors 118, 120 and 122 to raise the potential on the control electrode of Darlington pair 114 and turn on that switch, completing an energizing path for the lockout actuator 30, this energizing path being through actuator 30, this energizing path being through actuator 30, auxiliary relay coil 34, resistor 112 and Darlington pair 114 to ground bus 60. Thus lockout actuator 30 is energized even though there is no request for burner operation and if the spurious flame condition persists, the burner system will lockout, opening contacts 30-2 (preventing operation of the burner system) and closing contacts 30-1 (energizing alarm 14). The burner control electronics do not respond and neither relay 32 nor 36 is energized as there is no power on bus 58 during off heat intervals.

Thus the flame sensing and lockout circuits are continuously energized (independent of a call for heat) and in response to a call for heat and consequent operation of blower 16 to establish sufficient air flow to close switch 38, transistor 246 is triggered into conduction to apply power to bus 58 and energize the timing circuitry to commence the timing of sequential intervals controlled by the charging and discharging of capacitor 124. As in the FIG. 1 embodiment, capacitor 124, diode 154 and resistor 158 are mounted on a plug in unit and thus enable ready change of the timing of either or both intervals. A first (pre-ignition) time interval is controlled as a function of the RC values in the capacitor charging circuit and at the end of that interval transistors 138 and 146 are triggered into conduction. That action latches both transistors 138 and 146 and connects the plus side of capacitor 124 to resistor 122, abruptly dropping the voltage applied to diode 160. This voltage transition turns off transistor 116 and Darlington pair 110 is switched into conduction producing current flow through lockout actuator 30, resistor 222, Darlington pair 110, bus 178, control relay coil 32 and resistor 100. Thus at the initiation of the second (ignition) interval heating of the lockout actuator 30 commences and simultaneously relay 32 is pulled in, initiating an ignition condition by energizing pilot fuel control 18 and spark transformer control 20. Conduction of transistor 146 also turns off transistor 170 and the voltage on bus 178 supplied to the base of transistor 172 through resistor 176 turns on clamp transistor 172, clamping the control electrode of Darlington pair 114 to the ground bus 60 through diode 174 and preventing turn on of Darlington pair 114. This alternate lockout actuator energizing path remains disabled as long as the transistors 138, 146 are latched in conducting condition and there is voltage on bus 178.

As capacitor 124 discharges, the potential at the base of transistor 116 rises. After a time interval determined essentially by the value of capacitor 124 and resistor 158, transistor 116 is turned on again, turning off Darlington pair 110 and terminating the second (ignition) time interval and, if an alternate control relay energizing path (through flame relay 36) has not been established, de-energizing control relay actuator 32. When power is removed from bus 178 clamp transistor 172 is released so that the voltage at the control electrode of Darlington pair 114 rises (transistor 146 being turned on), turning on that switch 114 and continuing the heating of lockout actuator 30 through the alternate energizing path until the end of its time delay when it opens normally closed contacts 30-2, shutting down the burner system, and closes normally open contacts 30-1, energizing alarm 14.

This lockout sequence is interrupted by appearance of flame signal pulses at terminals 200, 202 which via transistor 94 switches on transistor 104 and after time delay determined in part by capacitor 220 also switches on transistor 250. The emitter of transistor switch 250 is connected to the emitter of transistor 251 and through resistor 253 to the base of transistor 251. The collector of transistor 251 is connected to bus 254 and application of power to that bus completes an alternate relay actuator maintaining circuit through actuators 36 and 32.

The flame signal on bus 108 is also applied to the divider network of resistors 118, 120 and 122 and capacitor 182 is charged. Should there be a flame failure removing the flame signal from bus 108, the signal transition will be coupled by capacitor 182 and release the latched transistors 138, 146 and the circuit will automatically recycle through the two sequential timing intervals. If the unlatching circuit of capacitor 182 and diode 184 is omitted in either embodiment, flame failure will cause transistor 104 to cease conduction, the resulting absence of voltage on bus 178 will release the clamp on the control terminal of Darlington pair 114 and the alternate lockout energizing circuit will be switched into conduction because of latched transistor 146. In such embodiments the system will lockout without recycle on flame failure.

The modification shown in FIG. 2 corresponds generally with that described with reference to FIG. 1 but having additional desired features and modified operating characteristics. The description of FIG. 2 will include description of the modifications to the extent necessary to understand the changes, the construction and operation of the modified circuit of FIG. 2 being otherwise generally in accordance with that of FIG. 1.

The FIG. 2 modification achieves changes in operation as follows:

1. If airflow is interrupted during the pre-purge period the timing is reset such that a full T1 period occurs when airflow is reinstated.

2. At the end of pilot ignition interval T2 flame must be detected or the sequence is interrupted by making pilot stabilization interval T3 of zero duration.

3. Airflow failure during the firing cycle will terminate operations.

Figure 2:
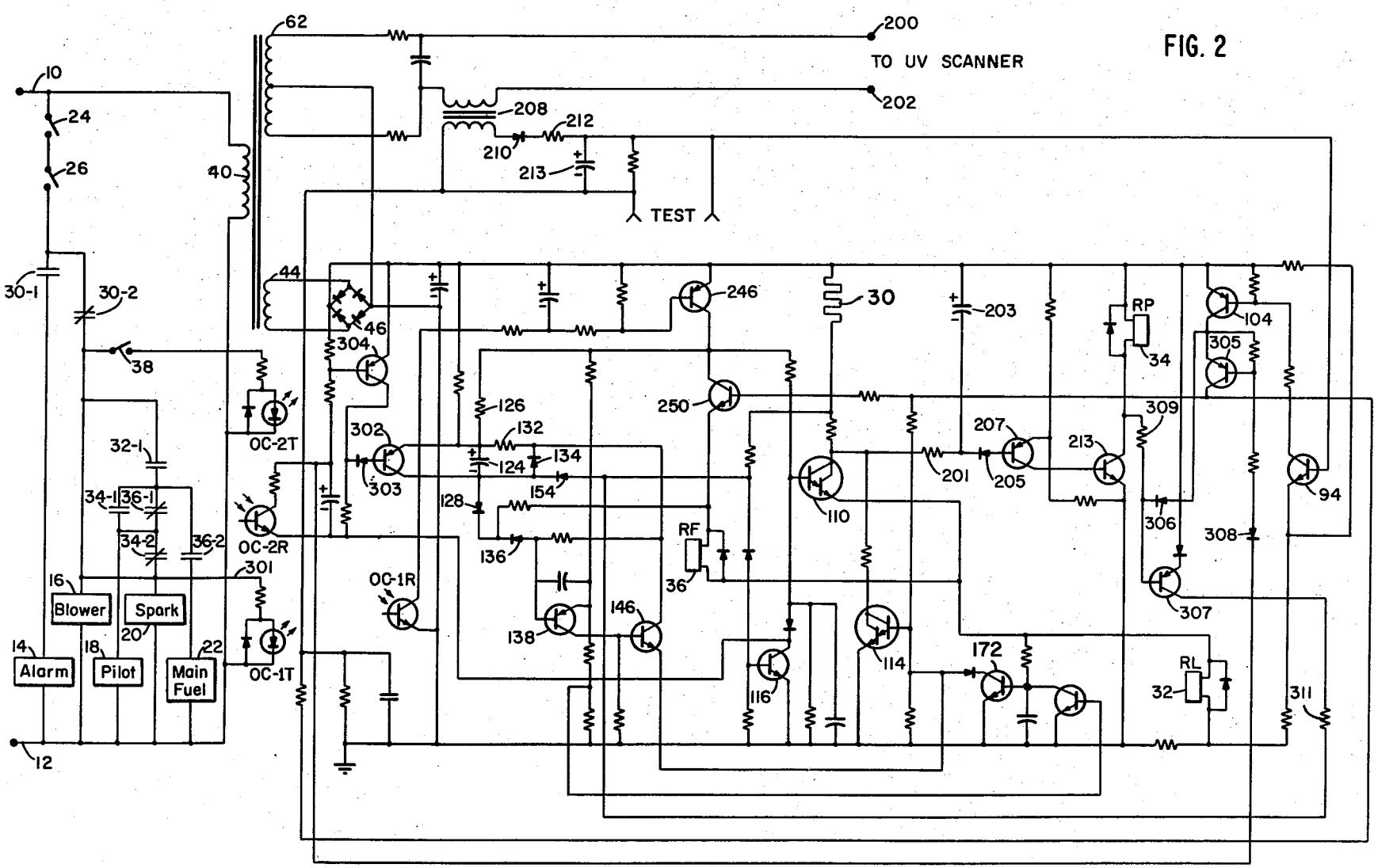
FIG. 2 is a schematic diagram of a modification.

Referring now to FIG. 2, significant changes relative to FIG. 1 will be described.

When blower unit 16 is energized power is also supplied to energize via line 301 an optical coupler transmitter device OC-1T which has a corresponding receiving sensor OC-1R. The receiver OC-1R is connected in circuit to drive the base of transistor 246. Thus when blower 16 is energized transistor 246 is conductive to apply B+ voltage to transistor 250 as previously described for FIG. 1. In the FIG. 2 circuit transistor 250 directly energizes relay 36 and transistor 251 (of FIG. 1) has been eliminated.

The charging circuit for capacitor 124 has been modified by the addition of a reset discharge transistor 302 which has its collector-emitter path connected across capacitor 124. The base of transistor 302 is coupled through a diode 303 to be driven by the collector circuit of transistor 304 which in turn has its base driven from an optical coupler receiver OC-2R. The receiver OC-2R is energized to conduction by a transmitter OC-2T which itself is energized whenever blower switch 38 is closed indicating that airflow is present.

In FIG. 2 the base of transistor 250 is driven from the collector of a transistor 305 which has its emitter connected to the collector of transistor 104. Thus, flame detection signal derived from the UV scanner connected terminals 200, 202 is applied at the base of transistor 94 and operates as in FIG. 1 to drive the base of transistor 104 which has its collector circuit coupled by diode 306 to the base of a transistor 307 which is also coupled via resistor 309 to the collector of transistor 213. Thus conduction in transistor 104 representing the flame presence signal controls conduction in both transistor 250 and transistor 307. The transistor 305 has its base circuit coupled through diode 308 to the collector side of receiver OC-2R. The emitter side of OC-2R is connected to the collector of transistor 116.

The modified operation of the circuit of FIG. 2 will now be described. With respect to the first modification the presence of airflow which closes switch 38 energizes OC-2T to produce conduction in receiver OC-2R which turns on transistor 304 and removes the drive signal from transistor 302. Accordingly, transistor 302 is open-circuited and capacitor 124 can charge and discharge as previously described. Upon failure of airflow and opening of switch 38 the optical coupler OC-2T, 2R, removes the drive for transistor 304 which applies signals via diode 303 to the base of transistor 302 to cause it to conduct thereby shorting capacitor 124 and resetting the timing cycle controlled thereby. Such reset is indicated in FIG. 3 by the dotted line on the charge characteristic for capacitor 124.

With respect to the second modification in operating characteristic, the detection of flame signal causes transistor 104 to conduct thereby, through coupling diode 306, preventing conduction in transistor 307 and the timing circuit for capacitor 203 remains as previously described. If no flame signal is present the resulting conduction in transistor 213 when signal coupled from the collector thereof through resistor 309 makes transistor 307 conduct. The collector of transistor 307 coupled through resistor 311 will immediately discharge capacitor 124 thereby terminating the T3 interval. This effect is indicated in FIG. 3 by the dotted line on the discharge characteristic for capacitor 124. The appearance of the transistor 307 collector signal on diode 154 terminates conduction in transistor 110 and drops out relay 32 (RL).

The third operational change provides that if airflow is interrupted thereby opening switch 38 during the main firing cycle, both relays 36 and 32 are dropped out. Thus the failure of signal in optical coupler OC-2R is applied via diode 308 to remove the drive signal from the base of transistor 305 thereby interrupting conduction in transistor 250 to de-energize the relays 36 and 32. This results in lockout condition because the latch transistors 138 and 146 remain conducting, energizing Darlington 114 since transistor 172 is turned off.

The foregoing arrangements can be utilized to achieve the desired modes of operation as described thereby providing improved reliability and safety and avoiding various combinations of conditions which have proved to be a disadvantage in the past. The invention, accordingly, is to be understood as including those combinations of structure for operation as defined in the appended claims.

I claim:

1. Burner control apparatus for use with a fuel burner installation having an operating control to produce a request for burner operation, a flame sensor to produce a signal when flame is present in said fuel burner installation, and means responsive to said burner control apparatus for independently controlling pilot and main fuel flow, said burner control apparatus comprising:

a control device for actuating said fuel control means;

electronic circuit timing means for providing an ignition cycle having successive timing intervals including in sequence a preignition purge interval, a pilot ignition interval, a pilot stabilization interval, and a main fuel ignition interval which begins at the termination of the pilot stabilization interval and continues for a predetermined time after said pilot stabilization interval terminates;

means responsive to a request for burner operation to initiate said ignition cycle by actuating said electronic circuit timing means;

means responsive to said actuated circuit timing means for energizing said fuel control means at the end of said pilot stabilization interval to actuate said main fuel control means and initiate main fuel flow;

flame signal responsive means responsive to a signal from said flame sensor when sensing a flame to maintain said control device energized;

means responsive to failure to establish pilot flame during said pilot stabilization interval for preventing the production of further timing intervals by said timing circuit means; and means responsive to loss of said signal from flame sensor after said pilot stabilization interval to terminate all fuel flow and disable said timing circuit to prevent further ignition cycle operation.

2. The apparatus as claimed in claim 1 wherein said timing circuit means includes two timing capacitors, the successive timing intervals being a function of the respective charge and discharge time of circuits which include said two timing capacitors.

3. The apparatus as claimed in claim 2 wherein the means for preventing further timing intervals includes a latch circuit that is enabled in response to completion of said pilot stabilization interval.

4. The apparatus as claimed in claim 3 wherein said latch circuit in actuated condition maintains one of said capacitors in discharged condition.

5. The apparatus as claimed in claim 3 wherein said latch circuit is responsive when enabled by a signal from said flame sensor.

6. The apparatus as claimed in claim 1 wherein said control device energizing means also energizes lockout circuitry and further including compensating circuitry to provide power supply compensation to stabilize the sensitivity of said flame signal responsive means circuitry during the concurrent energization of said lockout circuitry and said control device.

7. The apparatus as claimed in claim 6 comprising in addition a power supply, and wherein said flame signal responsive means includes a reference voltage provided by a voltage divider network connected to the power supply for said control circuitry, and compensation circuitry connected to said network to shift the voltage on said divider network and stabilize said reference voltage.

8. The apparatus as claimed in claim 1 and further including lockout circuitry for de-energizing said control apparatus comprising a switch, an actuator for operating said switch and two alternate paths for energizing said actuator, wherein said control device is connected in one of said lockout actuator energizing paths, said timing circuit energizes said one lockout actuator energizing path at the end of said pre-ignition timing interval, and said timing circuit means de-energizes said one lockout actuator energizing path and energizes the other lockout actuator energizing path at the end of said pilot stabilization timing interval in the absence of a signal from said flame sensor.

9. The apparatus as claimed in claim 8 and further including a pilot fuel control connected in said one lockout actuator energizing path.

10. The apparatus as claimed in claim 2 wherein one of said timing capacitors is mounted on a plug-in unit.

11. The apparatus as claimed in claim 10 wherein also mounted on said plug-in unit is a resistor that cooperates with said one timing capacitor in determining the duration of a timing interval provided by said timing circuit.

12. The apparatus as claimed in claim 11 and further including a lockout circuit for de-energizing said control apparatus and said plug-in unit includes a further circuit component, said further circuit component being connected between said timing circuit means and said lockout circuit when said plug-in unit is inserted in said control apparatus, said timing circuit and said lockout circuit being arranged so that, when said plug-in unit is not inserted in said control apparatus, said lockout circuit is energized in response to a request for burner operation and energization of said control device is prevented.

13. Burner control apparatus for use with a fuel burner installation having an operating control to produce a request for burner operation, a flame sensor to produce a signal when flame is present in said fuel burner installation, and means responsive to said burner control apparatus for controlling fuel flow, said burner control apparatus comprising:

a control device for actuating said fuel control means;

a timing circuit for providing a cycle having successive timing intervals including in sequence a pre-ignition purge interval, pilot ignition interval, a pilot flame stabilization interval and 9 main fuel ignition interval;

means responsive to a request for burner operation to initiate said ignition cycle by actuating said timing circuit;

means responsive to said actuated timing circuit for energizing said control device at the end of said pilot stabilization interval to initiate fuel flow to said burner;

flame signal responsive means responsive to a flame presence signal from said flame sensor to maintain said control device energized;

means responsive to failure to establish pilot flame during said pilot ignition interval for preventing both pilot fuel flow and initiation of a further ignition cycle by said timing circuit; and means responsive to loss of said flame presence signal from said flame sensor after said pilot stabilization interval to terminate all fuel flow and prevent initiation of a further timing cycle.

14. The apparatus as claimed in claim 13 wherein said timing circuit includes two timing capacitors, said successive timing intervals being a function of the respective charge and discharge time of circuits which include said two timing capacitors.

15. The apparatus as claimed in claim 14 wherein said means for preventing a further ignition cycle includes a latch circuit that is enabled in response to completion of said pilot ignition interval.

16. The apparatus as claimed in claim 14 wherein said latch circuit in actuated condition maintains one of said capacitors in discharged condition.

17. The apparatus as claimed in claim 15 wherein said latch circuit is responsive when enabled to a signal from said flame sensor.

18. The apparatus as claimed in claim 14 and including means responsive to loss of air flow during said pre-iginition purge period for resetting one of said timing capacitors to provide and initiate another ignition cycle having a full pre-ignition purge interval.

19. The apparatus as claimed in claim 13 and including means responsive to loss of air flow during main burner flame condition to terminate all fuel flow and disable said timing circuit to prevent further ignition cycle operation.

* * * * *